United States Patent [19]

Kashiwazaki et al.

[11] Patent Number: 4,738,226

[45] Date of Patent: Apr. 19, 1988

[54] STEAM BOILER WITH GAS MIXING APPARATUS

[75] Inventors: Masamichi Kashiwazaki; Toshiki Motai; Hisao Haneda, all of Tokyo, Japan

[73] Assignee: Mitsubishi Jukogyo Kabushiki Kaisha, Tokyo, Japan

[21] Appl. No.: 850,272

[22] Filed: Apr. 10, 1986

[30] Foreign Application Priority Data

Apr. 26, 1985 [JP] Japan ..... 60-90271

[51] Int. Cl.[4] ..... F22G 5/04

[52] U.S. Cl. ..... 122/480; 122/479 D

[58] Field of Search ..... 122/459, 460, 468–470, 122/476–478, 479 D, 480, 483, 235 F, DIG. 3, DIG. 6; 60/666; 126/351

[56] References Cited

U.S. PATENT DOCUMENTS

| | | | |
|---|---|---|---|
| 2,886,013 | 5/1959 | Chan | 122/479 D |
| 2,926,636 | 3/1960 | Paulison, Jr. | 122/479 D |
| 2,985,152 | 5/1961 | Paulison, Jr. | 122/479 D |
| 3,345,975 | 10/1967 | Stevens et al. | 122/480 |
| 3,396,705 | 8/1968 | Eickenberg | 122/480 |
| 3,643,634 | 2/1972 | Soh | 122/483 |

FOREIGN PATENT DOCUMENTS

| | | | |
|---|---|---|---|
| 758230 | 10/1956 | United Kingdom | 122/479 D |

*Primary Examiner*—Steven E. Warner

*Attorney, Agent, or Firm*—Wenderoth, Lind & Ponack

[57] ABSTRACT

A steam boiler which includes a rear flue containing superheaters, reheaters, economizers and the like, a plurality of gas passages, and one or more dampers for regulating the flow of gases passing through the plurality of gas passages. In this arrangement, a gas mixer is provided to evenly mix the gases at the outlets of the gas passages.

1 Claim, 4 Drawing Sheets

STEAM BOILER WITH GAS MIXING APPARATUS

BACKGROUND OF THE INVENTION

1. Field of the Invention

The present invention relates to an industrial boiler for use in connection, for example, with an electric power plant.

2. Description of the Related Art

FIG. 9 illustrates a conventional steam boiler. In such a boiler, fuel and air are introduced into a furnace 51 from a burner 62 for combustion purposes. The combustion gas then passes superheaters 63 and 64 and a reheater 65, all provided above the furnace 51, and thereafter, is delivered to a rear flue 52. The rear flue 52 is divided by a partition wall 53 into a first gas passage 54 and a second gas passage 55. The first gas passage 54 contains a reheater 56 and an economizer 57. A damper 60 is arranged below the ecomonizer 57 to regulate the flow of gas in the first gas passage 54. The second gas passage 55 contains a superheater 58 and an economizer 59. A damper 61 is arranged below the economizer 59 to regulate the flow of gas in the second gas passage 55. With this arrangement, the temperature of steam is controlled by the regulation of the flow of gases passing through the first and second gas passages 54 and 55. In this type of boiler, however, the flow of gases is subject to change when a different type of coal is used, or when load output in the boiler is varied. If this occurs, the temperature of gas at the outlet of the first gas passage 54 is likely to differ from that of gas at the outlet of the second gas passage 55. Such gases are delivered to systems downstream of the outlets of the first and second gas passages 54 and 55 without mixing the gases to a full extent. This leads to malfunction of a denitrification system or an air heater, causing malfunction of the boiler. It should be mentioned that particularly in a dry denitrification system, excessive increase or decrease in the temperature of gases directed thereto may deteriorate the activity of catalyst. It should also be mentioned that conventional boilers provide no means for accommodating various types of coals.

Another conventional boiler is shown in FIG. 10, wherein like reference numerals designate like parts in FIG. 9. A dry denitrification system is provided at the downstream of the economizers 57 and 59. The temperature of gases at the outlet of the economizers 57 and 59 tends to decrease as load output in the boiler decreases. It is necessary to maintain the temperature of gases at the outlet of the denitrification system as high as possible for the maximum operating efficiency of the denitrification system as well as for the longer activity of catalyst. To this end, gas at upstream of the economizer 59 in the second gas passage 55 is partly directed to a by-pass passage. The gas in the by-pass passage then passes through a damper 67 and thereafter, is mixed with gases from the first and second gas passages 54 and 55. When the boiler steams at a low load output, the damper 67 is adjusted in such a manner to increase the flow of gas in the by-pass passage 66 and thereby to regulate the temperature of gases at the inlet of the denitrification system. In this boiler, however, no means is provided to equalize the temperature of gas at the outlet of the first gas passage 54 with that of gas at the outlet of the second gas passage 55. Thus, two different layers of gases flow in the duct and are delivered to the denitrification system. In order to maintain the minimum gas temperature, a large amount of gas is necessary in the by-pass passage 66. However, this may deteriorate the operating efficiency of the boiler while requiring the large by-pass passage 66.

SUMMARY OF THE INVENTION

It is, therefore, an object of the invention to provide a steam boiler which ensures maximum operating efficiency by mixing gases at the outlets of a plurality of gas passages.

It is another object of the invention to provide a steam boiler which may accommodate various types of coals.

It is a further object of the invention to provide a steam boiler which may facilitate maintenance and inspection of ducts and dampers.

According to the present invention, a steam boiler comprises a rear flue having a plurality of gas passages and containing heat transfer means and flow regulating means for regulating the flow of gases passing through the respective gas passages. A gas mixing means is provided to evenly mix the gases at the outlets of the gas passages, that is to evenly mix all of the respective portions of the gas flowing from the outputs of the respective gas passages.

BRIEF DESCRIPTION OF THE DRAWINGS

The above and other objects, features and advantages of the present invention will become more apparent from a consideration of the following detailed description when taken in conjunction with the accompanying drawings, in which.

DETAILED DESCRIPTION OF THE PREFERRED EMBODIMENTS

Figure 1:
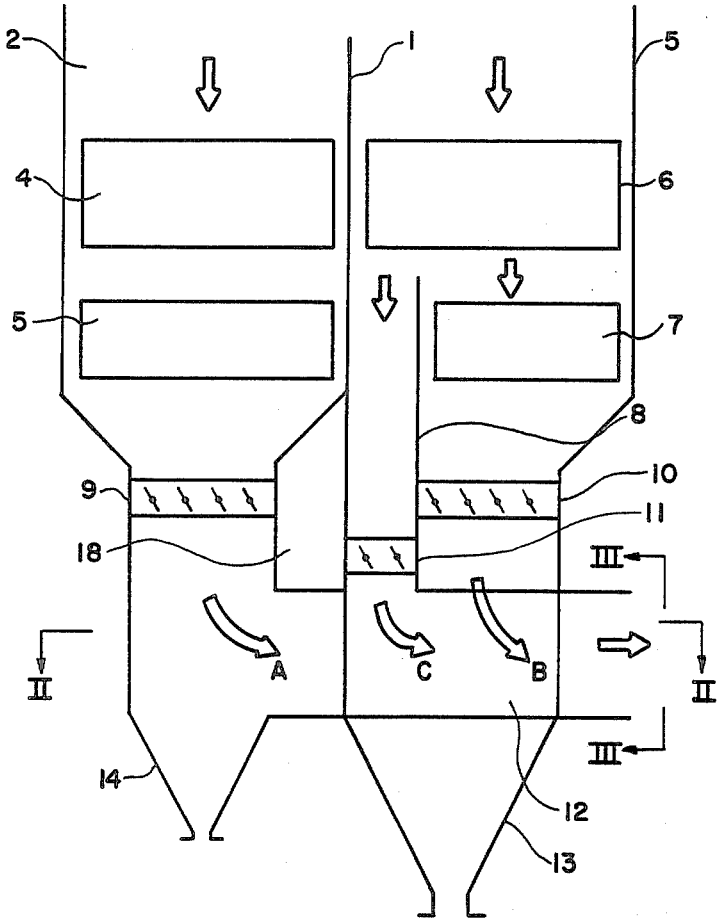
FIG. 1 is a front sectional view of a boiler according to a first embodiment of the present invention.

Throughout the following description like reference numerals designate like or corresponding parts shown in multiple figures of the drawing.

With now reference to FIGS. 1 to 4, there is shown a boiler according to a first embodiment of the present invention. In the first embodiment, the rear flue of the boiler is divided by a partition wall 1 into a first gas passage 2 and a second gas passage 3. The first gas passage 2 contains a reheater 4 and an economizer 5 placed downstream of the reheater 4. A damper 9 is arranged downstream of the economizer 5. Below the damper 9 is a hopper 14 to discharge ashes. The second gas passage 3 contains a superheater 6 and an economizer 7 placed downstream of the superheater 6. Below the economizer 7 is a damper 10. Also, a divider 8 is provided downstream of the superheater 6 within the second gas passage 3 to form a by-pass passage into which gas C is directed. A damper 11 is arranged in the by-pass passage to regulate the flow of the gas C.

Figure 2:
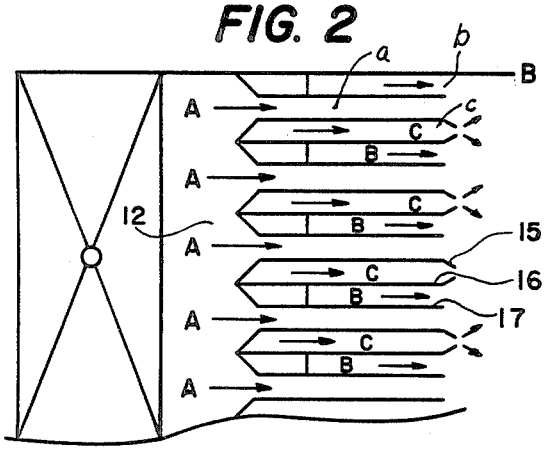
FIG. 2 is a view taken on the line II—II of FIG. 1.
Figure 3:
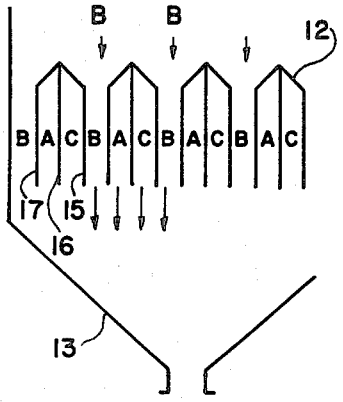
FIG. 3 is a view taken on the line III—III of FIG. 1.
Figure 4:
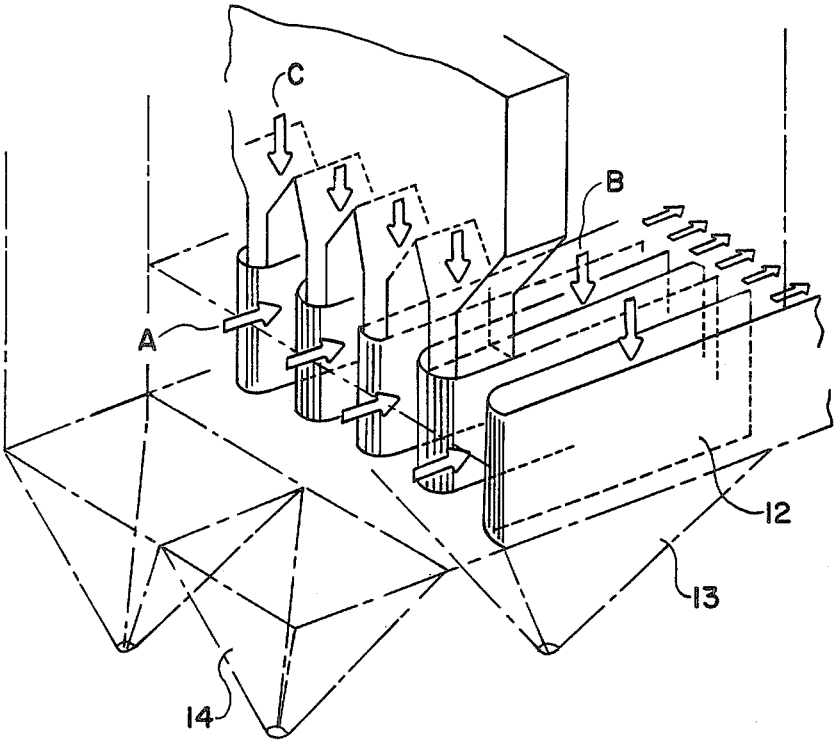
FIG. 4 is a perspective view of the boiler of FIG. 1.

A gas mixer 12 is situated at the outlet of the second gas passage 3. As shown in FIG. 2, the gas mixer 12 generally includes dividers 15, 16 and 17. The flow of gas B at the outlet of the second gas passage 3, that of gas C at the outlet of the first gas passage 2 and that of gas C at the outlet of the by-pass passage are subsequently adjusted thereby. That is, as can be seen in FIGS. 2 and 3, gases A, B and C are subdivided so as to flow through passages a, b and c between the dividers and mixed at the outlets of the divider passages since the outlets of adjacent divider passages communicate with different ones of the outlets of the first, second and bypass passages. Thereafter, the gases A, B and C are conveyed to a gas duct provided downstream of the gas mixer 12. The gas mixer 12 is simple in configuration and thus, pressure loss is remarkably low. Below the gas mixer 12 is a discharge opening to prevent accumulation of ashes in the gas passages and a hopper 13 to discharge the ashes to an ash handling system.

An inspection space 18 is formed between the first gas passage 2 and the second gas passage to allow inspection and maintenance of the ducts and the dampers.

According to the first embodiment, the gases A, B, and C are evenly mixed at the same time at the outlets of the respective gas passages so that the temperature of the gas is equalized. This provides maximum operating efficiency of the denitrification system and the other systems downstream thereof. Therefore, the boiler is capable of readily accommodating various types of coals and changing its load output, thereby improving the operability of the boiler.

Additionally, the by-pass passage is formed in the second gas passage 3. Thus, it is unnecessary to provide a plurality of high temperature ducts separately, thereby improving the reliability of the boiler and saving spaces.

Still further, pressure loss in the gas mixing zone is materially low, thereby improving the operating efficiency of the boiler.

The ash discharge opening is formed below the gas mixer 12 and the hopper is provided therebelow to discharge ashes. Such an arrangement prevents congestion in the gas mixing zone due to attachment or accumulation of ashes to the gas mixer 12.

Figure 5:
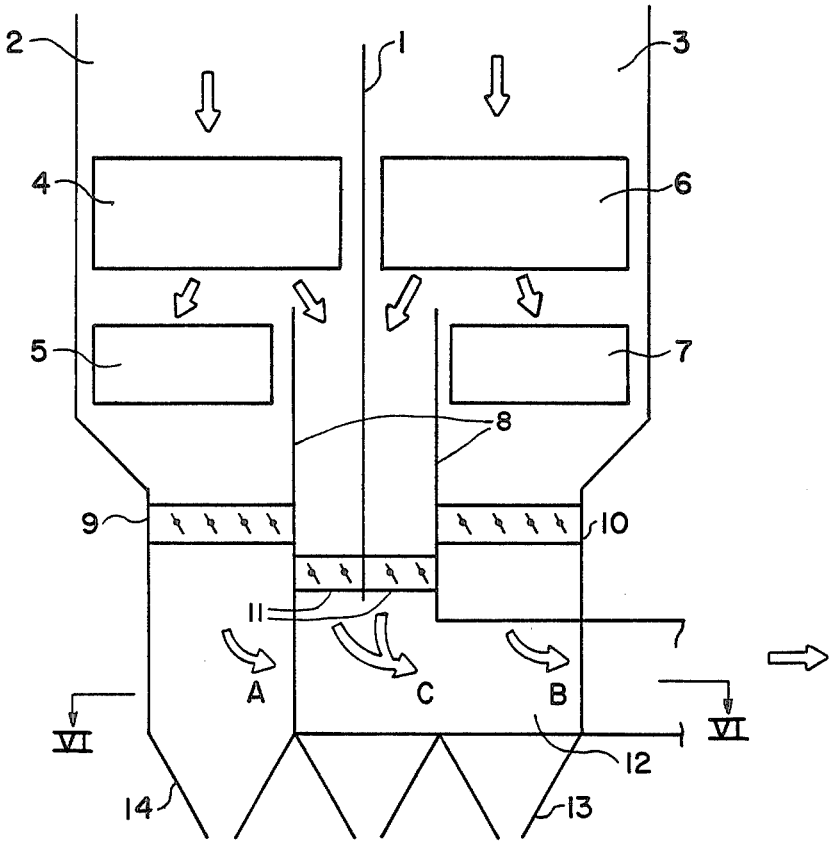
FIG. 5 is a front sectional view of a boiler according to a second embodiment of the invention.
Figure 6:
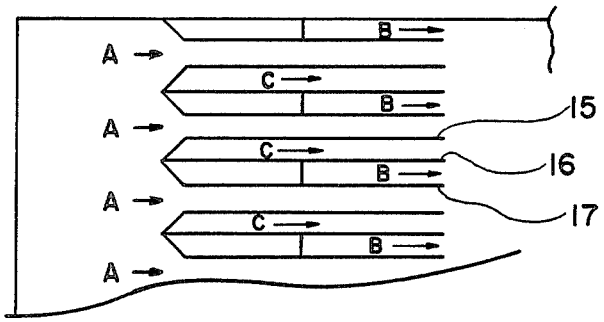
FIG. 6 is a view taken on the line VI—VI of FIG. 5.

FIG. 5 and FIG. 6 illustrate a boiler according to a second embodiment of the invention. In this embodiment, the first and second gas passages 2 and 3 are both provided with the dividers 8 to form therein by-pass passages. The by-pass passages contain respective dampers 11. These dampers are associated with the damper 9 in the first gas passage 2 and the damper 10 in the second gas passage 3 to thereby adjust distribution of the gases in response to load output and the type of coal employed. The remaining parts in this embodiment are identical to those in the first embodiment and therefore, are not explained herein. Also, the second embodiment has the same effect as the first embodiment and therefore, such effect will not be explained.

Figure 7:
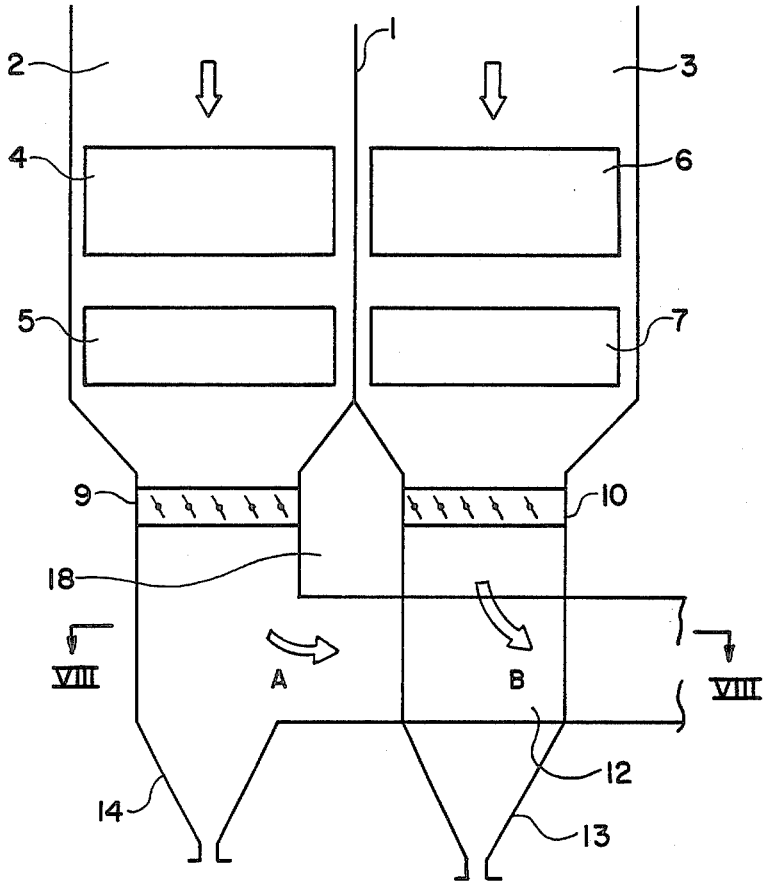
FIG. 7 is a front sectional view of a boiler according to a third embodiment of the invention.
Figure 8:
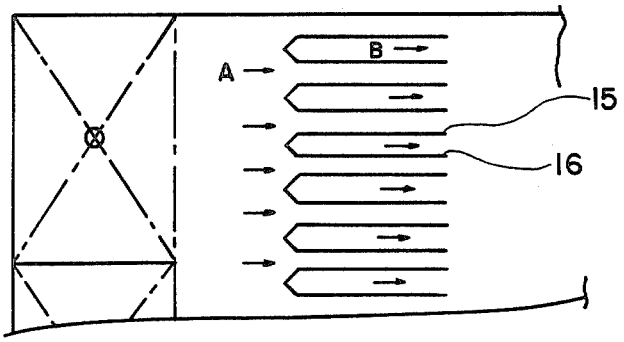
FIG. 8 is a view taken on the line VIII—VIII of FIG. 7.
Figure 10:
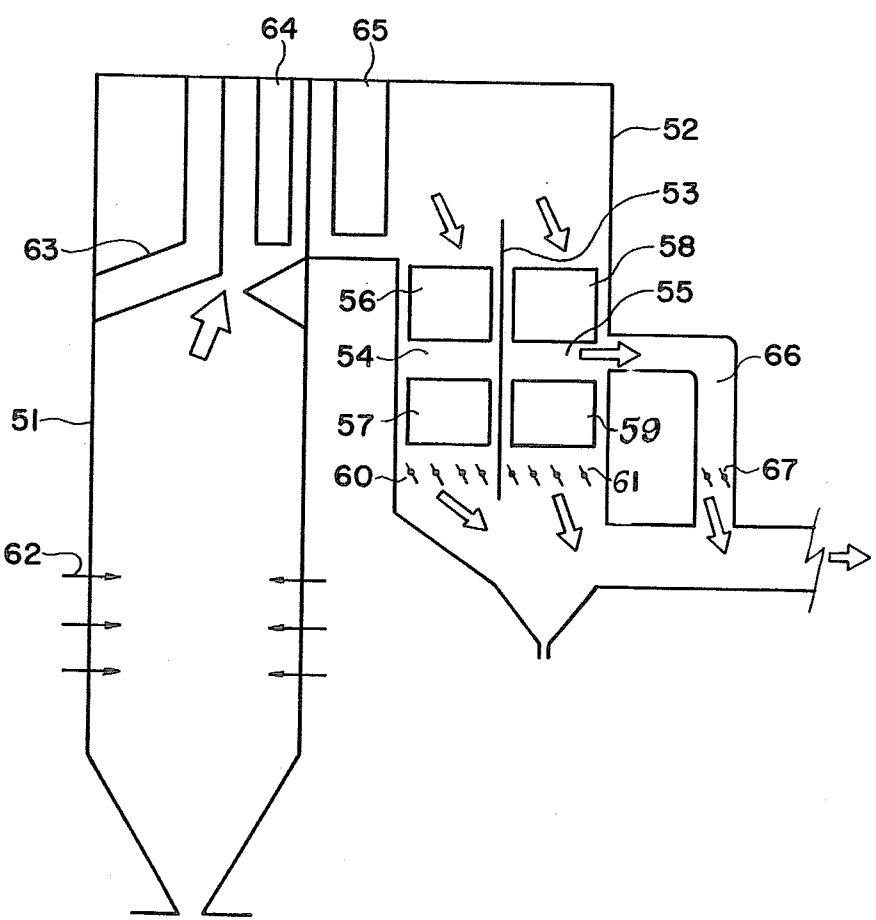
FIG. 10 (PRIOR ART)
FIGS. 9 and 10 are front sectional views of conventional boilers, respectively.
Figure 9:
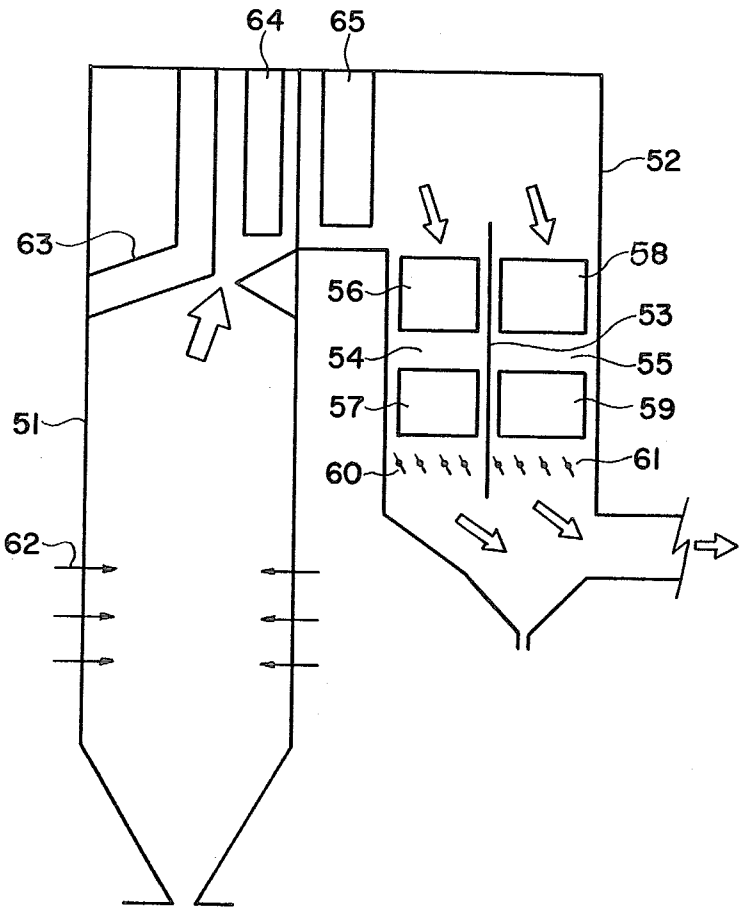
FIG. 9 (PRIOR ART)

FIG. 7 and FIG. 8 illustrate a third embodiment of the invention. This embodiment neither provides the divider 8 nor the by-pass gas passage, unlike the first embodiment. The remaining parts in this embodiment are the same as in the first embodiment and are, therefore, not explained herein.

According to the third embodiment, the gases A and B are evenly mixed at the same time at the outlets of the respective gas passages so that the temperature of the mixed gas is equalized. This provides maximum operating efficiency of the denitrification system and the other systems downstream thereof.

Hence, the boiler is capable of accommodating various types of coals and readily changing its load output, thereby improving the operability of the boiler.

Still further, pressure loss in the gas mixing zone is materially low, thereby improving the operating efficiency of the boiler.

The ash discharge opening is formed below the gas mixer 12 and the hopper is provided therebelow to discharge ashes. This arrangement prevents congestion in the gas mixing zone due to attachment or accumulation of ashes to the gas mixer 12.

While there has been described what is at present considered to be the preferred embodiments of the invention, it will be understood that the invention is not limited thereto, and that various changes and modifications may be made without departing from the scope of the invention.

What is claimed is:

1. A steam boiler comprising:

means for combusting a fuel to produce a combustion gas;

a rear flue;

means for directing the combustion gas from said combustion means to said rear flue;

heat transfer means, including superheaters and reheaters, disposed in said rear flue;

a plurality of gas passages in said rear flue for guiding respective portions of the combustion gas of differing temperature therethrough to respective outlets of said plurality of gas passages;

temperature regulating means, including flow regulating means for regulating the flow of gas through said plurality of gas passages, for regulating steam temperature in said superheaters and reheaters; and gas mixing means, disposed at said outlets of said plurality of gas passages, for evenly mixing together all of the respective portion of the combustion gas guided through said plurality of gas passages so as to provide at the outlet of said rear flue a flow of combustion gas of uniform temperature, said gas mixing means including means, including a plurality of dividers, for subdividing each of the respective portions of the combustion gas at said outlets of said plurality of gas passages into subdivided portions, through divider passages between said dividers, and directing the subdivided portions through said divider passages to divider outlets thereof, adjacent ones of each of the divider outlets communicating with different ones of said outlets of said plurality of gas passages via said divider passages.

* * * * *